US005735060A

United States Patent [19]

Atzinger et al.

[11] Patent Number: 5,735,060

[45] Date of Patent: *Apr. 7, 1998

[54] DRYER SECTION INCLUDING A DEVICE AND METHOD FOR TRANSFERRING A STRIP OF PAPER FROM A FIRST TREATMENT STATION TO A SECOND TREATMENT STATION IN A PAPER MACHINE

[75] Inventors: Erlfried Atzinger, Appleton, Wis.; Hans-Peter Sollinger, Heidenheim, Germany; Gerhard Kotitschke, Steinheim, Germany; Hans Jurgen Wulz; Peter Kahl, both of Heidenheim, Germany; Wolfgang Mueller, Giengen, Germany

[73] Assignee: Voith Sulzer Papiermaschinen GmbH, Germany

[ * ] Notice: The term of this patent shall not extend beyond the expiration date of Pat. No. 5,600,897.

[21] Appl. No.: 685,712

[22] Filed: Jul. 24, 1996

Related U.S. Application Data

[63] Continuation of Ser. No. 102,766, Aug. 6, 1993, abandoned, and Ser. No. 386,007, Feb. 9, 1995, which is a continuation of Ser. No. 151,255, Nov. 12, 1993, Pat. No. 5,600,897.

[51] Int. Cl.[6] ..... F26B 11/02

[52] U.S. Cl. ..... 34/117; 34/641; 34/643

[58] Field of Search ..... 34/114, 116, 120, 34/122, 117, 115, 123, 641, 643

[56] References Cited

U.S. PATENT DOCUMENTS

| | | | |
|---|---|---|---|
| 3,868,780 | 3/1975 | Soininen et al. | 34/116 |
| 4,566,944 | 1/1986 | Mauranen et al. | 162/286 |
| 4,945,655 | 8/1990 | Wedel | 34/23 |
| 5,050,317 | 9/1991 | Kade et al. | 34/117 |
| 5,101,577 | 4/1992 | Wedel | 34/114 |
| 5,177,880 | 1/1993 | Preisetanz et al. | 34/117 |
| 5,232,554 | 8/1993 | Kotitschke | 162/193 |
| 5,283,960 | 2/1994 | Sims et al. | 34/117 |
| 5,321,899 | 6/1994 | Kade et al. | 34/114 |
| 5,539,999 | 7/1996 | Kuhasalo | 34/455 |
| 5,555,638 | 9/1996 | Lehosvuo et al. | 34/117 |
| 5,586,397 | 12/1996 | Kerttula et al. | 34/114 |

FOREIGN PATENT DOCUMENTS

| | | |
|---|---|---|
| 479748 | 4/1992 | European Pat. Off. . |
| 3941242 | 6/1991 | Germany . |
| 4328554 | 3/1994 | Germany . |
| 137061 | 6/1990 | United Kingdom . |

OTHER PUBLICATIONS

U.S. Patent Application Serial No. 08/102,766, (corresponding to German reference 4328554).

*Primary Examiner*—Henry A. Bennett
*Assistant Examiner*—D. Doster
*Attorney, Agent, or Firm*—Ostrolenk, Faber, Gerb & Soffen, LLP

[57] ABSTRACT

In a drying section of a paper making machine, the paper web is conducted through a plurality of single tier dryer sections and then transferred to at least one final double tier dryer section for completing the drying process. The paper web is threaded through the open draw between the single tier dryer sections and the double tier dryer section and through the open draws between the lower cylinders and the upper cylinders in the double tier dryer section by use of air jets which blow at the paper web from opposite sides thereof. The air jets include at least one jet which blows in a direction generally opposite to that of the paper web.

16 Claims, 9 Drawing Sheets

OF
UF
F
9
S
11
12
13
14
15
16
17
51
51'
52
52'
53
53'
54
54'
55
55'
56
56'
57
57'
58
59

OF
UF
9
21
22
23
24
25
71
71'
72
72'
73
73'
74
74'
75
75'

DRYER SECTION INCLUDING A DEVICE AND METHOD FOR TRANSFERRING A STRIP OF PAPER FROM A FIRST TREATMENT STATION TO A SECOND TREATMENT STATION IN A PAPER MACHINE

This is a continuation of U.S. patent application Ser. No. 08/386,007, filed Feb. 9, 1995, which is a continuation of U.S. patent application Ser. No. 08/151,255 filed Nov. 12, 1993, now U.S. Pat. No. 5,600,897; and further wherein this instant application is a continuation of U.S. patent application Ser. No. 08/102,766 filed Aug. 6, 1993, now abandoned.

BACKGROUND OF THE INVENTION

The present invention relates to a dryer section for the drying of traveling web, preferably as part of a paper manufacturing machine.

The invention relates to a dryer section having a mix of single-tier and double-tier dryer groups as known, for example, from U.S. Pat. No. 5,232,554 the contents of which are incorporated by reference herein. Such a dryer section is divided into a plurality of successive dryer groups. Each of these dryer groups comprises a plurality of heatable dryer cylinders which come into contact with the web and which are coupled to a (preferably) common drive. The art distinguishes between double-felt (double-tier) and single-felt (single-tier) dryer groups. A single-felt dryer group has only a single endless felt (or a single endless wire). This felt travels together with the web alternately over the drying cylinders and guide or transfer rolls that are preferably designed as suction rolls and which are located between the drying cylinders. Such single-felt dryer groups are customarily arranged at the starting portion of the dryer section to which the web to be dried is fed in a condition in which the web is still relatively wet (solids content: about 35–55%, depending inter alia on the paper grade and machine speed). On the other hand, one or more double-felt dryer groups are customarily provided in the final region of the dryer section. Each of these dryer groups has an upper row of cylinders and a lower row of cylinders, the web travelling alternately over the upper and lower cylinders. The one or more double-felt dryer groups may be arranged directly behind a single-felt dryer group. As an alternative, an additional device (e.g. a size press or an intermediate calender) may be interposed.

Prior art drying sections deploying a mix of single and double-tier dryer groups (hereinafter "mixed drying section") are essentially of two types. In accordance with a first type, the dryer cylinders belonging to the single-tier group or groups constitute a relatively small portion, e.g. about 20% of the total drying surface traversed by the paper web through the entire drying section. In other words, about 80% of the total drying surface is comprised of the dryer cylinders in the double-tier dryer groups.

In the second type of a mixed drying section, substantially most of the total drying surface traversed by the paper web, i.e. more than about 75%, is comprised of the surfaces of the dryer cylinders which belong to the single-tier dryer groups. The remaining 25% is located in the double-tier drying cylinders. In other words, prior art mixed drying sections either are overwhelmingly single-tier or overwhelmingly double-tier. The prior art has not focused attention on the question whether there is an optimal mix that should be provided between the number of single-tier drying cylinders and double-tier drying cylinders and, if so, the precise number of cylinders of each type which should be provided.

The present invention also relates to a method as well as to a device for transferring a strip of paper, i.e. a paper web foil, from a first treatment station (dryer section) to a second treatment station in a paper machine. The following prior art is known:

(1) Federal Republic of Germany 43 28 554 A1

(2) Federal Republic of Germany 39 41 242 A1

Reference (1) shows and describes a dry end of a paper machine. This dry end has, in a first section, a single-row dryer group with a single felt. The felt, with the web resting on it, travels alternately over drying cylinders and guide suction rolls.

In a second section, the dry end has two rows of drying cylinders with two felts. In this case, the web travels alternately over the lower and upper cylinders.

Upon the starting, i.e. threading, of the paper machine, a narrow edge strip (called a tail) is first passed through the entire dry end. Blast nozzles serve in this connection for the transfer of the foil from one drying cylinder to the other.

The blast nozzles produce air jets which extend substantially in the direction of transfer of the edge strip. The air jets thus drive the edge strip in the desired direction, namely from a first (upstream) drying cylinder to a second (downstream) drying cylinder in order to transfer the edge strip from the first drying cylinder to the second drying cylinder.

This transfer has always been a problem. It frequently was not possible to directly transfer the edge strip at given places. At times, there is a fluttering of the edge strip so that the entire process of the passing of the edge strip is time-consuming. This, however, means relatively long downtime of the paper machine, and thus reduced production.

Reference (2) also shows and describes the transfer of a narrow edge strip in the dry end of a paper machine. In this case, a jet of air is produced which is directed opposite the direction of travel of the web of paper. However, this reference does not describe a free, i.e., open-chain transfer of the paper strip. Rather, the paper strip adheres to the outer surface of a cylinder and is scraped from the latter by a scraper, the blast air supporting the detachment.

SUMMARY OF THE INVENTION

One aspect of the present invention is concerned with the precise ratio of single-tier and double-tier drying cylinders that are to be provided in a drying section. The inventors herein reject the prior art conventional wisdom which provides too few single-tier drying cylinders, since that approach ignores problems of runnability—too many paper breaks—and greater difficulty in threading. On the other hand, the inventors discovered that configuring a dryer section entirely of single-tier dryer groups, or even overwhelmingly of single-tier groups, ignores significant advantages provided by double-tier dryer groups. Advantages of double-tier dryer groups include: ease of providing a tail cutter function; avoidance of paper bursting at certain dryness levels; achieving shorter building lengths; assuring no felt or fabric tearing and significantly reduced fabric wear; lower machine fabrication costs as compared to a total single-tier or an overwhelmingly single-tier construction; lower operating costs (steam expenditures and the like) than with total single-tier; improved overall paper quality; and enhanced visibility and control of the open draws of the paper.

Another aspect of the present invention is concerned with the problem of threading of the web to be dried into the dryer section. As is known, the following is provided for this purpose. The web which is formed and mechanically dewatered in the initial part of the paper manufacturing machine travels during the starting (threading) phase at full operating speed, but temporarily only up to the end of the press section or up to the first dryer cylinder of the dryer section. From there, it passes downward into a broke pulper. A narrow edge strip, referred hereinbelow as a "striplet" or "tail" is now separated from the web. It is passed first of all through the single-felt dryer group or groups (generally several are present). It is known that this can be done without the aid of ropes. In other words, an automatic ropeless tail guide device, i.e., a tail threading device, is present. For example, the tail is detached from the individual cylinders by means of a scraper which is combined with an air-blow nozzle. Furthermore, special edge suction chambers are provided in the transfer suction rolls, a relatively high vacuum being produced in said chambers during the tail threading process, independently of the other part of the guide suction roll.

In contrast, in accordance with Federal Republic of Germany 4037661 (which is an equivalent to said U.S. Pat. No. 5,232,554), a rope guide is provided for the threading of the tail in the subsequently located double-felt dryer group or groups. This arrangement has disadvantages. It can cause operational disturbances. The tail can slip off the rope. Further, the tail is not guided with sufficient precision. Tearing of the rope is also possible. It is therefore desirable to completely avoid rope guides in the entire dryer section of modern paper manufacturing machines. This is particularly true at the increasingly greater operating speeds encountered nowadays (on the order of magnitude of 1500 to 2500 m/min).

In order to achieve this object, an automatic ropeless tail guide device is provided in accordance with the invention in the double-felt dryer group or groups. Examples of parts of different constructions suitable for this are described in the following publications:

Federal Republic of Germany Patent 1 245 278;

Federal Republic of Germany Utility Model 8 914 079; and

Federal Republic of Germany Utility Model 9 109 313.

Experiments have shown that the reliability of pneumatically acting parts is less than Satisfactory when the solids content of the web is still relatively low. Above a certain solids content and taking into account other factors, and depending on the paper grade and other parameters, however, these pneumatically acting parts operate well.

The inventors herein have studied the problems encountered in transferring a paper web from a single-tier to a double-tier dryer group and the operational difficulties encountered in threading a paper web through a double-tier dryer group and have found that an optimal transfer from a single-tier dryer group to the double-tier dryer group(s) depends on various parameters including: paper grade; stiffness of the paper web, particularly of the transfer tail; strength of the paper web, particularly of the transfer tail; dryness, i.e., solids content, of the paper web; operating speeds; basis weight of the paper web; desired paper properties in the final paper product; and runnability. The results will be discussed in detail later, in connection with a transfer point table presented in the Detailed Description section of the instant specification.

For rebuilds, costs and other considerations should be taken into account. One consideration is machine down time during a machine rebuild. It should be as short as possible, to have the least impact on paper production. Consonant with this objective, only one or perhaps two groups of an old double-tier machine might be converted to single-tier. The desire to keep the down time as short as possible might militate in favor of selecting a transfer point low in the range of possible values, or at the point between the first possible transfer point and the optimal transfer point, shown in the aforementioned transfer point table.

According to the invention, with some of the paper grades the transfer of the paper web into the double-felt dryer groups should occur at a point where the paper web has already traversed about 30–60% of the paper web contacting surface of the entire drying section. For example, a drying section including a total of 40 drying cylinders of same diameters, of which 21 are in the single-tier section and 19 in the double-tier section, meets the condition since, at the end of the single-tier dryer groups, the paper web will have traversed more than 50% of the total surface of all the drying cylinders.

In order to reliably automatically thread the paper web from the single-tier groups to and through the open draws of the double-tier groups the invention relies on two advantageous factors. First, with the conditions set forth above, the paper web develops a stiffness and firmness that is high enough for threading purposes. Second, again with the conditions set forth above, the paper web will not tend to adhere to the surface of the drying cylinders of the double-tier group or groups because the adhesion force decreases after the wet web has passed approximately 20–30% of the web contacting surface of the dryer section. By operating in accordance with the invention, the paper web is in the double-tier group(s) at a state where its adhesion to the drying cylinders is low enough to assure both good runnability and reliable automatic (ropeless) tail threading.

By constructing the drying section to include a mix of single and double-tier groups, the invention significantly shortens the overall length of the drying section, resulting in savings in machine and building costs, compared with a total single-tier configuration. The invention further obtains an optimal and prompt transfer point for the paper web between the single and double dryer groups.

In column 7, lines 10–40 of U.S. Pat. No. 4,232,544 measures are described for further conducting the oncoming tail in the known dryer section within the region of the end of the single-felt dryer group, not into the double-felt dryer group but rather temporarily into the cellar or other locations or receiving bins associated with the paper machine. Only after stable travel of the tail through the single-felt dryer group or groups has been obtained is the tail then conducted further into the double-felt dryer group or groups. The contents of U.S. Pat. No. 4,232,544 are incorporated by reference herein.

Another aspect of the invention concerns advantageous arrangements of the cylinders and felt guide rolls in the transition region between the last single-felt dryer group and the directly or indirectly following double-felt dryer group. It is particularly favorable if the web passes substantially downward through the place of separation between the two dryer groups.

Still another aspect of the invention is concerned with the problem of the removal of broke, which occasionally is produced in the event of a tear in the paper web. This task, which can never be entirely excluded, is present, in particular, in the initial region of the dryer section, i.e. in the region of the single-felt dryer groups. It is best if all single-felt dryer groups are felted on top. In such a case, the paper broke can simply fall downward under the force of gravity, in particular with arrangement of the cylinders in horizontal rows, as generally customary.

If, however, in order to obtain the most uniform possible properties on both sides of the finished web of paper, it is desired that both sides of the web of paper alternately contact the dryer cylinders, not only in the double-felt dryer group but also in the region of the single-felt dryer groups, then an arrangement of the cylinders in vertical or V-shaped rows is particularly advantageous. In this connection, reference is made to U.S. Pat. Nos. 5,050,317 and 5,177,880, the contents of which are incorporated by reference herein. The latter describes inter alia a dryer-section configuration having a plurality of V-shaped dryer groups felted on top and having two bottom-felted dryer groups in the shape of a V, and arranged to provide an optional gap that can be opened for the removal of broke between the lowermost cylinders of these two dryer groups.

If the above-mentioned transfer rolls required in the single-felt dryer group are designed as suction rolls, they can be provided with an inner stationary suction box which can also serve for defining a desired suction zone for threading. However, a construction is preferred in which the inside of the transfer suction rolls is free of stationary inserts. Furthermore, a hollow journal serving for the drawing-off of air is not necessary in order to provide a vacuum inside the roll. Rather, an external suction box is provided (for example, in the pocket between two adjacent dryer cylinders).

A final aspect of the invention is concerned with the problem of the height above a horizontal reference plane at which the axes of rotation of the cylinders and/or guide rolls of the single-felt dryer group or groups are advantageously arranged, for instance with respect to the required free evaporation path for the paper web between two cylinders. Another factor is the arrangement of these axes of rotation relative to the planes in which the axes of rotation of the cylinders of the following double-felt dryer group lie.

It is common to all the various embodiments of the invention that at least one double-felt dryer group is always present in the region of the end of the dryer section. The following advantages (some already mentioned) result from this:

1. Uniform quality of the paper, particularly approximately equal properties of the surface on both sides of the paper, which uniform quality is also obtained in the cross machine direction, obtaining improved printability and reduction of curl tendencies in comparison to paper produced with a total single-tier configuration;
2. Even if a very high final solids content is desired (on the order of 98%), there is no danger of tearing (or breaking) of the paper web since longitudinal stresses are relieved in the double-felt group;
3. The tail cutter required at the end of the dryer section can be readily arranged in the traditional manner in the double-felt dryer group;
4. No rope guide for the pulling-in of the tail is required at any place in the entire dryer section; and
5. Wear of the felts (sometimes observed in the end region of known dryer sections which have exclusively single-felt dryer groups) is avoided by the presence of the double-felt dryer groups.

The present invention is also concerned with providing a method and a device for transferring a strip of paper from a first treatment station (dryer Section) to a second treatment station, and particularly from a first drying cylinder to a second drying cylinder in order to permit the transfer with greater reliability and higher speed.

Other features and advantages of the present invention will become apparent from the following description of the invention which refers to the accompanying drawings.

DETAILED DESCRIPTION OF THE INVENTION

Figure 1:
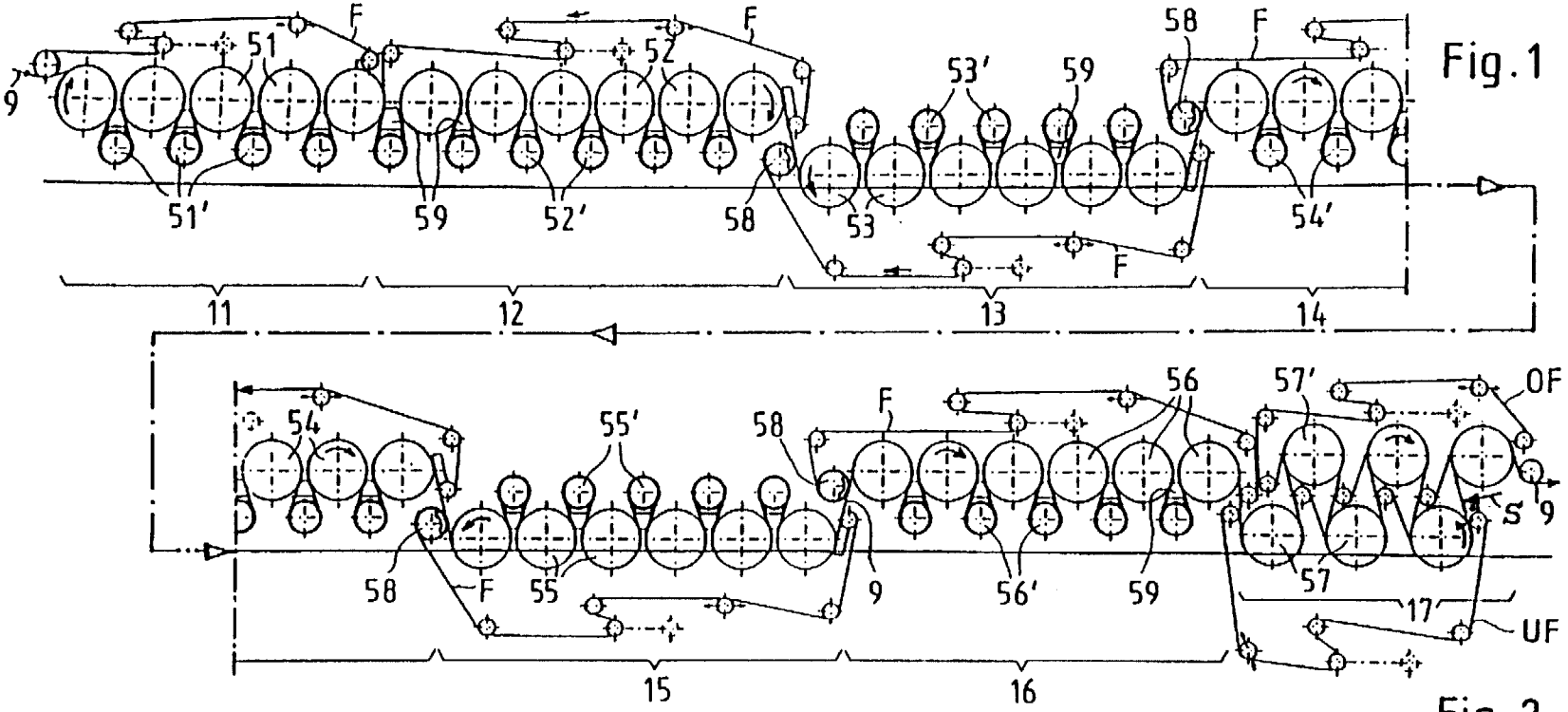
FIGS. 1 to 4 show diagrammatic side views of several different dryer section having a plurality of single-felt dryer groups and at least one subsequent double-felt dryer group.

The dryer section shown in FIG. 1 has located first in the path of the paper web six single-felt dryer groups 11–16, arranged one behind the other. Each of these dryer groups has a single endless felt F. For example, in the first dryer group 11, the felt F travels together with the web 9 alternately over dryer cylinders 51 and guide suction rolls 51'. In the first two dryer groups 11 and 12, as well as in the fourth and sixth dryer groups 14 and 16, the bottom of the web comes in contact with the cylinders. Accordingly, the dryer cylinders 51, 52, 54 and 56 lie in this embodiment above the corresponding guide suction rolls 51', 52', 54' and 56', respectively. The cylinders are in this case "top-felted". This is different in the third dryer group 13 and in the fifth dryer group 18. Here the cylinders 53, 55 contact the top side of the web. They are therefore "bottom-felted" and lie' below the corresponding guide suction rolls 53', 55'. Accordingly, the paper web transfer regions between the dryer groups 12 to 16 are developed using web reversal mechanisms. For the details of these web reversal mechanisms, reference is made to U.S. patent application Ser. No. 867,411, filed Apr. 13, 1992, the contents of which are incorporated by reference herein.

It can be noted from FIG. 1 that at each of these web regions, the paper web 9 forms a short open draw; i.e. it is temporarily not supported by a felt. In the region of a small suction zone of a transfer roll 58, it travels in each case onto the next felt. In FIG. 1, these transfer rolls 58 are the sole suction rolls having internal stationary suction boxes. The guide suction rolls 51' to 56', on the other hand, do not have inner stationary inserts or direct suction connections. Rather, an external suction box 59 is provided on each of these transfer suction rolls. This box lies in the pocket between two adjacent dryer cylinders and has a ledge 60 (see FIG. 7) at the place where felt F and web 9 leave-together the first of these two cylinders, the ledge 60 stripping off and diverting the layer of boundary air-carried along by the felt.

The last single-felt dryer group 16 is followed by a double-felt dryer group 17 having several bottom cylinders 57 and several top cylinders 57', as well as a bottom felt UF and a top felt OF. Here, the web 9 travels meandering between the lower and upper cylinders. In FIG. 1, a tail cutter S is indicated between the last two cylinders.

Figure 2:
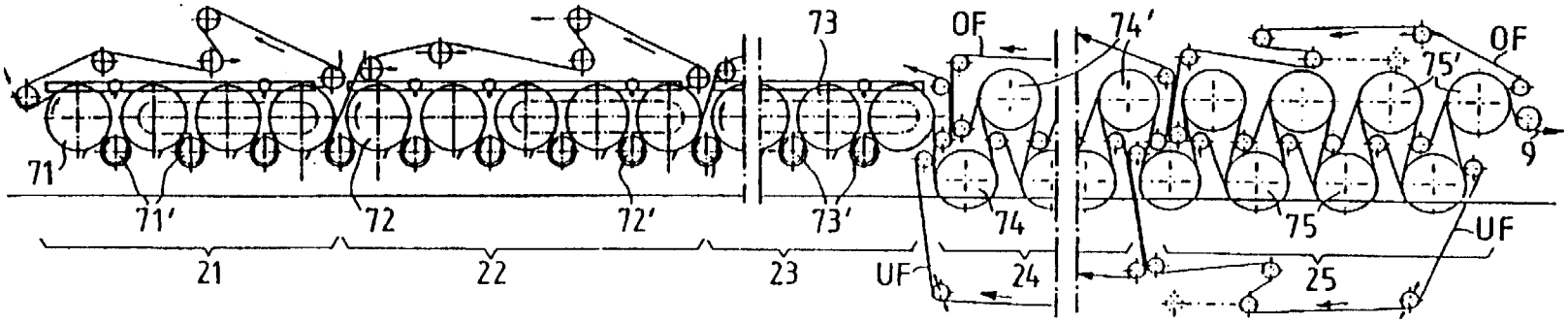

The dryer section shown in FIG. 2 has for instance three (or four or five) single-felt dryer groups 21–23; however, in contrast to FIG. 1, they are all top-felted. In other words, all dryer cylinders 71–73 contact the bottom side of the web. Another difference from FIG. 1 is that the guide suction rolls 71' to 73' have inner stationary suction boxes and are arranged at only a slight distance from the adjacent dryer cylinders. Furthermore, for example, two (or three) double-felt dryer groups 24, 25 are provided with bottom cylinders 74, 75 and with top cylinders 74' and 75'.

Figure 3:
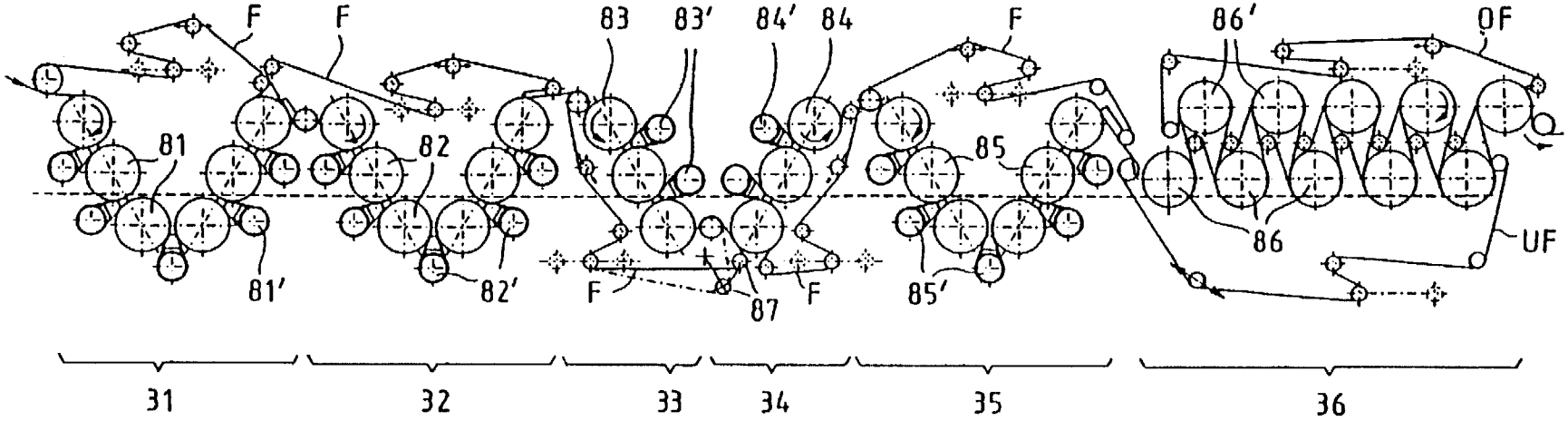
Figure 4:
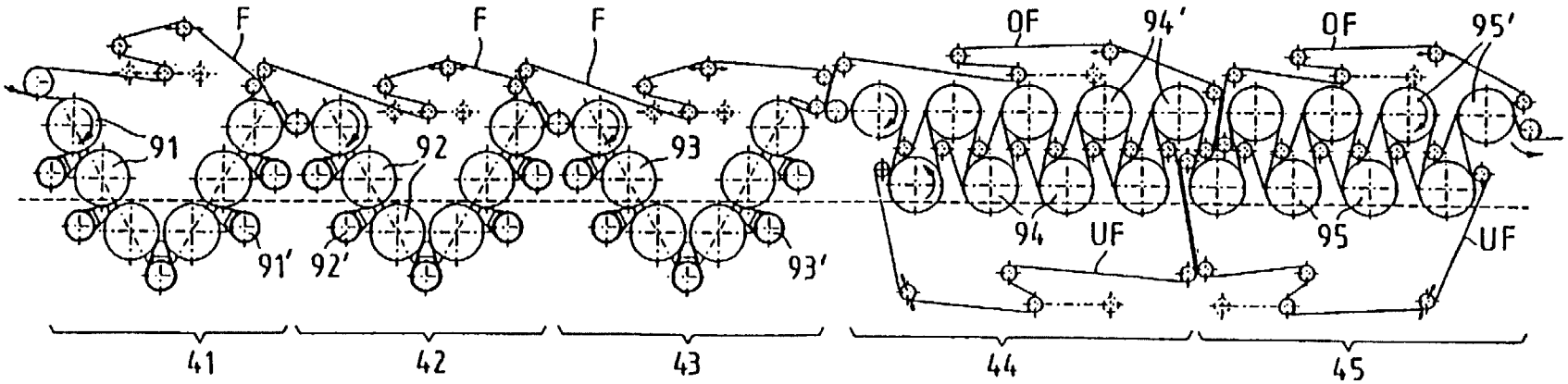

The dryer sections of FIGS. 1 and 2 have only horizontal rows of cylinders. In FIGS. 3 and 4, however, in order to shorten the overall structural length of the dryer section, the cylinders of the single-felt dryer groups are arranged in several rows which are inclined to the vertical direction, with rows inclined rearward alternating with rows that are inclined forwards. In accordance with FIG. 3, two V-shaped double rows form a first group 31 and a second dryer group 32. The cylinders 81, 82 of these two dryer groups are top-felted. This is followed by two bottom-felted dryer groups 33, 34. For example, the three (or four) cylinders 83 of the third dryer group form a rearward inclined row. On the other hand, the cylinders 84 of the fourth dryer group form a forward inclined row.

Between the lowermost cylinders of these two dryer groups 33, 34, a slot or gap can be opened by a swingable felt guide roll 87, in order to remove broke in the downward direction. The fifth dryer group 35 again has solely top-felted dryer cylinders 85, which again form a V-shaped double row. Behind the last cylinder of this dryer group 35, the web is guided obliquely downward to the first lower cylinder 86 of the following double-felt dryer group 36. In accordance with FIG. 4, solely top-felted and V-shaped single-felt dryer groups 41, 42 and 43 are present, followed by two double-felt dryer groups 44 and 45. In both FIGS. 3 and 4 all transfer suction rolls 81' to 85' and 91' to 93' which are located in the corresponding dryer group between two cylinders are arranged at a larger distance from these cylinders and are provided with external suction boxes. This manner of construction does not merely involve less expense. It furthermore also saves drying section energy since a longer free evaporation path is-present between every two cylinders so that the drying is more economical. These latter factors apply also to the arrangement in accordance with FIG. 1.

Figure 5:
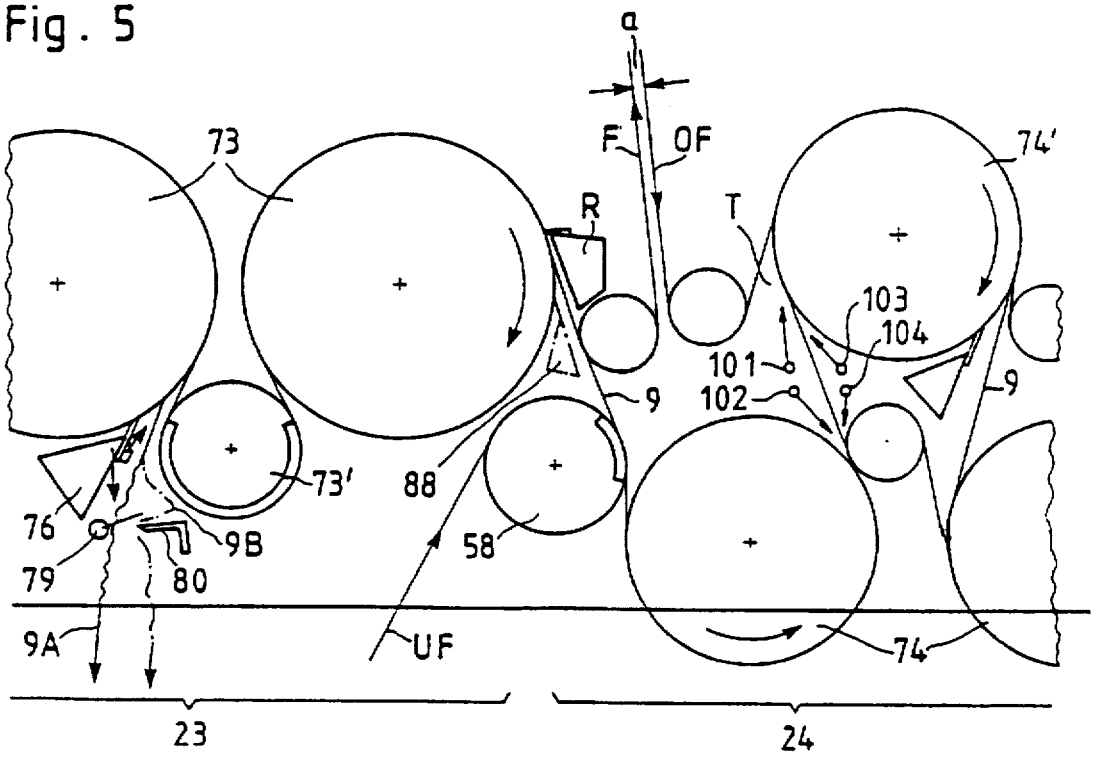
FIGS. 5 to 8 show diagrammatic side views (on a larger scale than in FIGS. 1 to 4) of the web transfer zone between a single-felt dryer group and a following double-felt dryer group having a corresponding tail guide means.

FIG. 5 shows, in the case of another dry end, the transfer region between the last single-felt dryer group and the first double-felt dryer group. There can be noted here the last two drying cylinders 73 of the last single-felt dryer group 23 and the first three cylinders 74, 74' of the double-felt dryer group 24. There can furthermore be noted a guide suction roll 73' provided with inner suction box and, in front of the first lower drying cylinder 74, a transverse suction roll 58, also having a stationary inner suction box. An automatic rope-less edge-strip guide device is formed in the single-felt dryer group 23, for instance in the manner that each guide suction roll 73 has a known edge-suction zone on one of its two ends. Furthermore, airblast devices are provided on a scraper support body 76, which devices are indicated symbolically by arrows, as well as an air blast nozzle 79. At the place where the web 9 and the felt F jointly leave the last cylinder 73, an edge suction box R (active only in the region of the edge strip), web stabilizer, or the like, can be arranged. Or, a short "edge-strip guide scraper" 88 which covers only the region of the edge strip and which may also have an air-blast nozzle, is arranged on the last cylinder 73.

The blast nozzles 101, 102, 103, 104 shown in FIG. 5 are absolutely decisive. They serve for the transferring of an edge strip from the first lower drying cylinder 74 of the double-felt dryer group 24 to the first upper drying cylinder 74' thereof. As can be seen, on both sides of the edge strip 9, there are blast nozzles 101, 103, the air jets of which are directed upward, .i.e., in the direction of transfer, as well as blast nozzles 102, 104, the air jets of which are directed downward and thus opposite the direction of transfer. The inventor has found that, in this way, an extremely stable guiding of the edge strip is possible. The air jets of the nozzles 101, 102 produce a conveying action in that they rapidly carry the edge strip along in upward direction to the drying cylinder 74'. The air jets of the two blast nozzles 102, 104, on the other hand, see to it that the edge strip assumes a stable position and, immediately after leaving the first lower drying cylinder 74 of the dryer group 24, assumes the correct direction to the first upper drying cylinder 74'.

The two blast nozzles 101, 102, as well as the two blast nozzles 103, 104, can be structurally combined, being thus borne by a single bracket.

Figure 14:
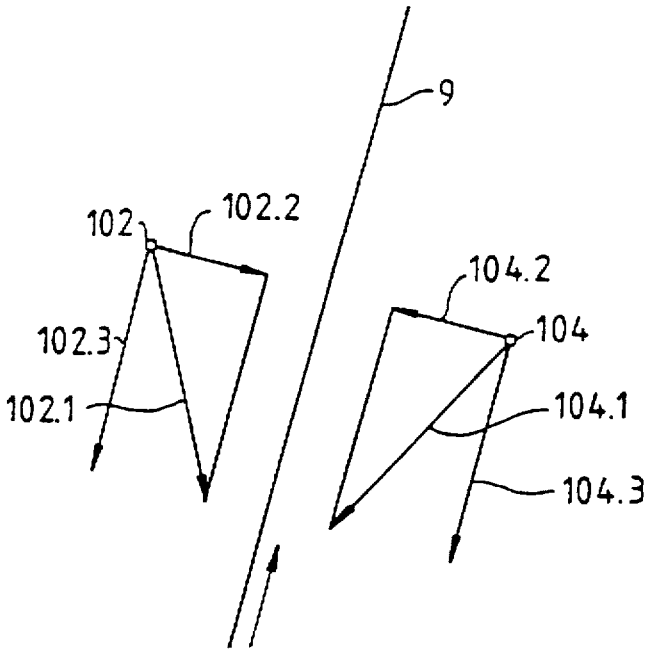
FIG. 14 graphically illustrates the transfer air jet directions in the web transfer regions.

In FIG. 14 the transfer region is again shown, on a larger scale. Again, the blast nozzles 102, 104 can be noted. The blast nozzles 101, 103 have been omitted for greater clarity of the drawing. As can be seen, air jet 102.1 from blast nozzle 102 has a component 102.2 which is perpendicular to the direction of the edge strip 9, and a component 102.3 which is exactly opposite to the direction of the edge strip 9. Exactly the same is true with respect to the air jets 104.1 from blast nozzle 104 having the components 104.2 and 104.3.

Figure 17:
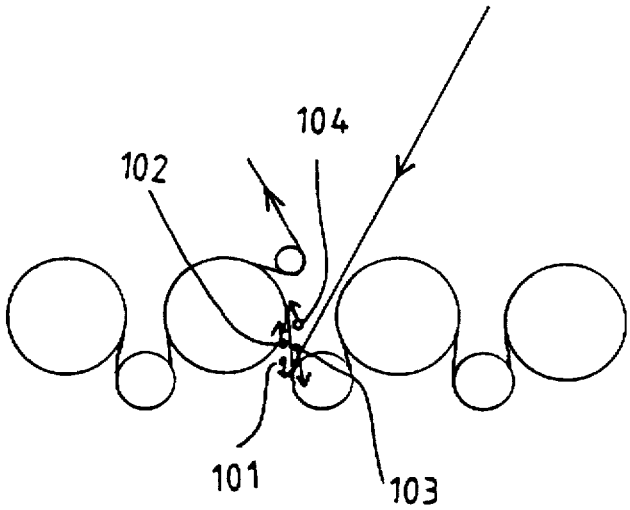
FIG. 17 graphically illustrates transfer air jets provided between two top-felted single-tier dryer sections.

It should be appreciated that the rope-less web transfer over an open draw illustrated and described above with reference to FIGS. 5 and 14 can be applied between individual dryers of a double-tier dryer, between single-tier and double-tier dryers and between single-tier dryer groups. In fact, it can be applied anywhere where the paper web encounters an open draw path. See, for example, FIG. 17.

Figure 6:
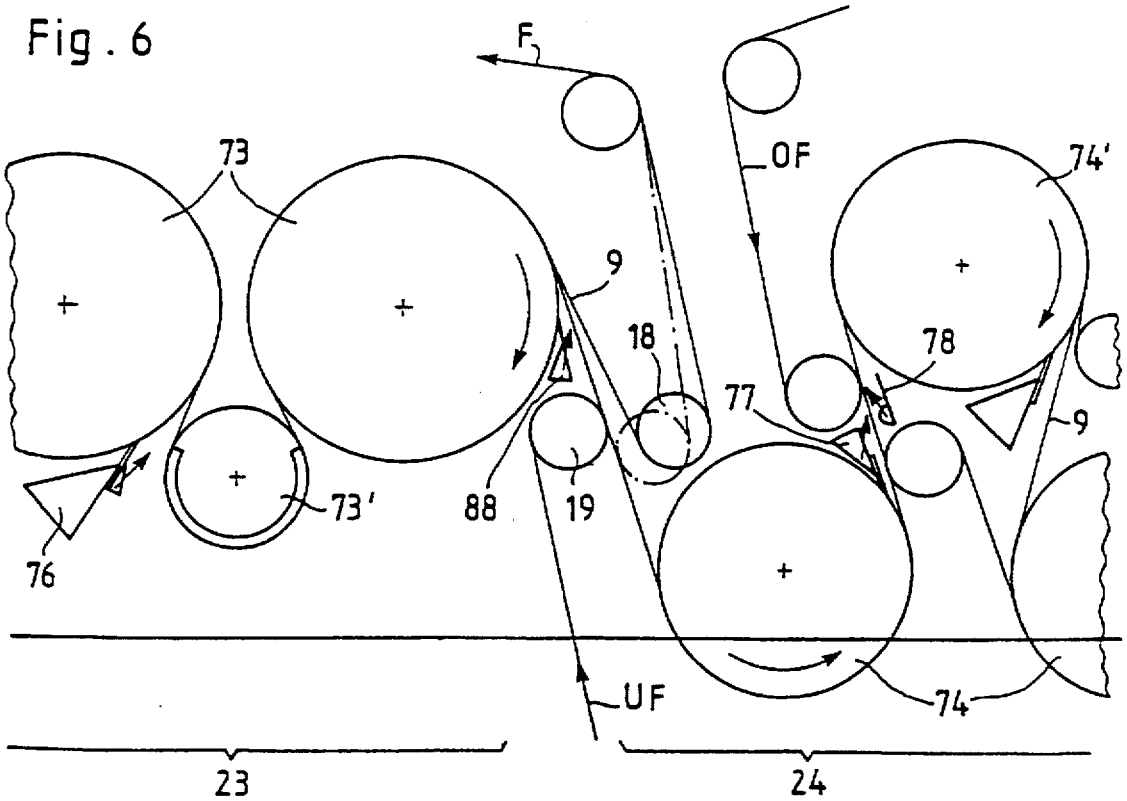

In accordance with FIG. 6, the following is provided between the last cylinder 73 of the single-felt dryer group 23 and the first lower cylinder 74 of the double-felt dryer group 24: A guide roll 18 for the felt F and a guide roll 19 for the bottom felt UF are so arranged that the felts overlap each other. During normal operation, a certain distance is present between the felts F and UF so that the web 9 travels freely, i.e., in an open draw, not supported by the felt F, from the cylinder 73 to the felt guide roll 19. During the threading of the tail, the guide roll 18 can be brought into the position shown in dash-dot lines so that the felts F and UF temporarily contact or almost contact each other. A tail guide scraper 88 can furthermore be provided.

Figure 7:
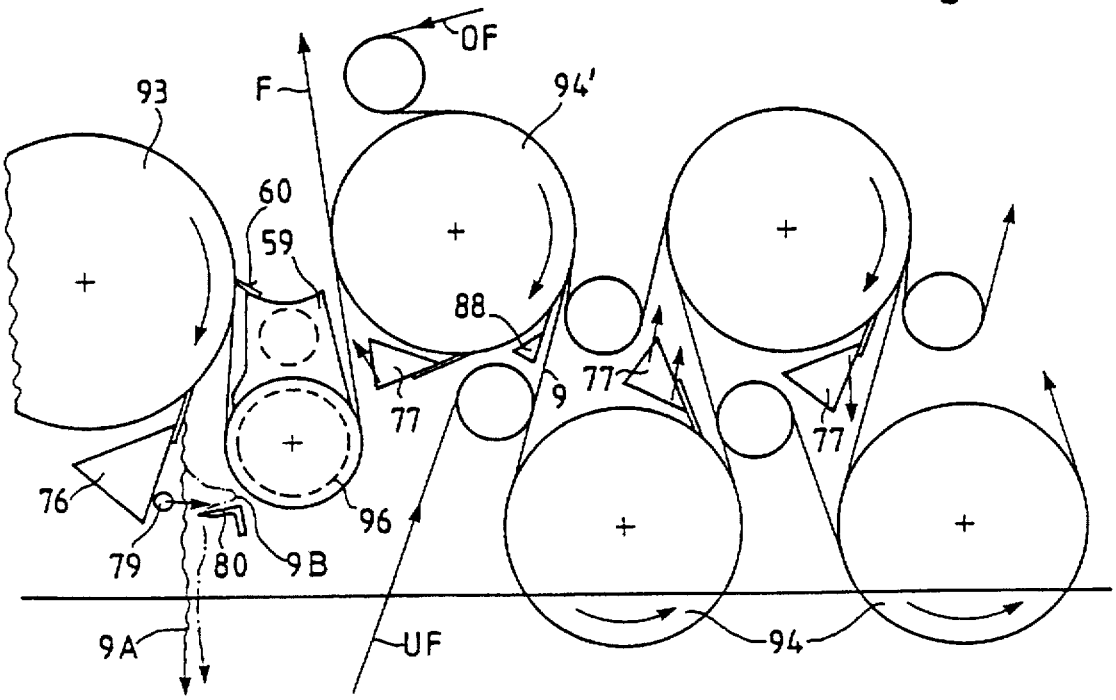
Figure 8:
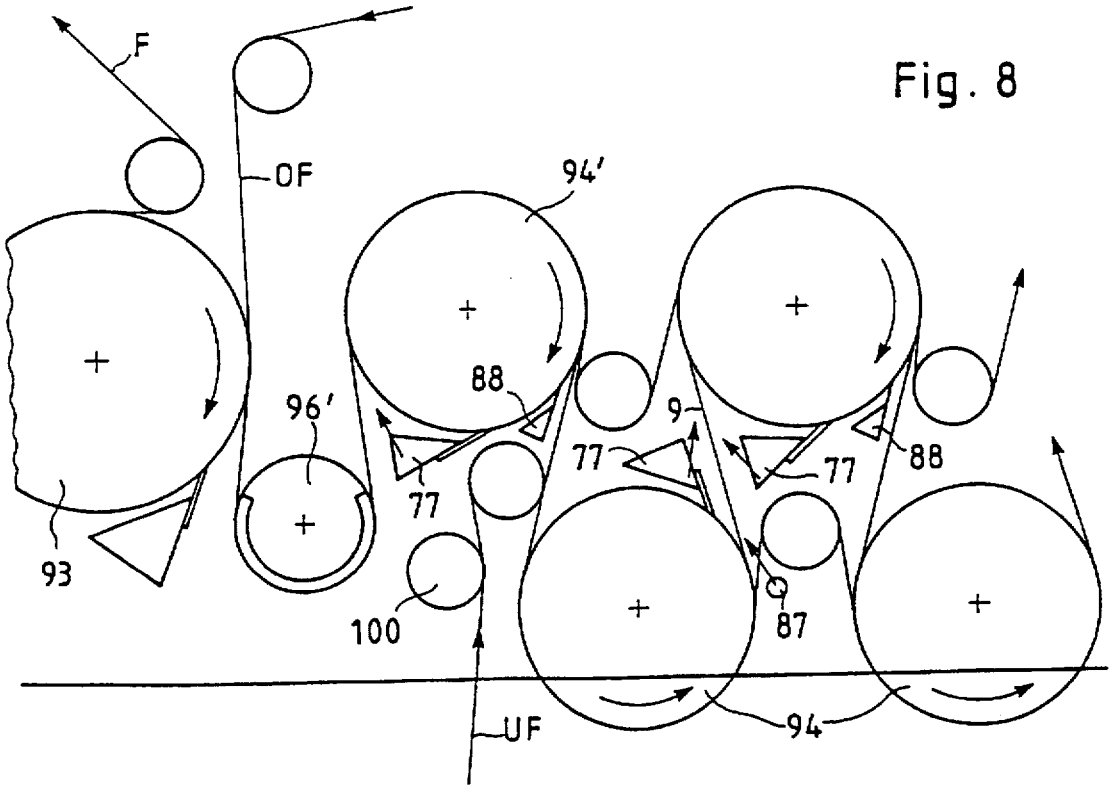

In FIGS. 7 and 8, the first cylinder 94' of the double-felt dryer group is an upper cylinder. Therefore a guide suction roll or reversing suction roll 96 is provided between it and the last cylinder 93 of the single-felt dryer group. This suction roll 96 can, as shown in FIG. 7, lie in the loop of the felt F of the single-felt dryer group, the felt F being tangent to the upper cylinder 94' and transferring the web 9 to it. In accordance with FIG. 8, the guide suction roll 96' can lie in the top felt of the double-felt dryer group. This felt tangentially contacts the last cylinder 93 of the single-felt dryer group and receives the web from it. An automatic ropeless tail guide device in the form of tail guide scrapers 88 and in the form of blow nozzles (represented symbolically by arrows) which are arranged on scraper support members 77 or on a separate blow pipe 87 can again be clearly noted in FIGS. 7 and 8. In order that the bottom felt UP which travels in the direction towards the first upper cylinder 94' does not unnecessarily convey air into the pocket T, an additional felt guide roll 100 (or an air scraper) can be provided.

Figure 9:
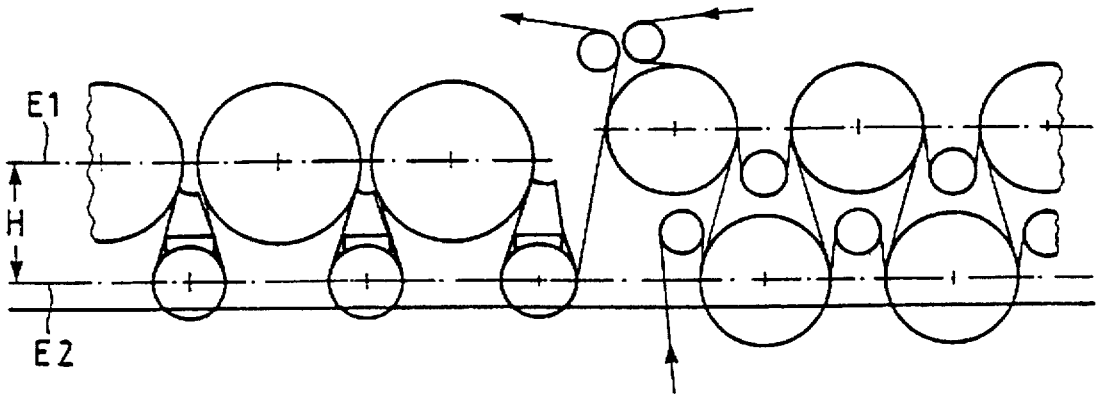
FIGS. 9 to 11 are similar to FIGS. 5 to 8 and show different vertical distances between the axes of the cylinders or guide rolls and a reference plane.

In FIG. 9 a larger distance H—as compared with FIG. 1—is provided between the planes E1 and E2 whereby an enlarged evaporation path is available for the web 9 between every two cylinders of the single-felt dryer group. The axes of the cylinders lie in plane El, while the axes of the transfer suction rolls, and at least approximately the axes of the lower cylinders of the double-felt dryer group, lie in plane E2.

Figure 10:
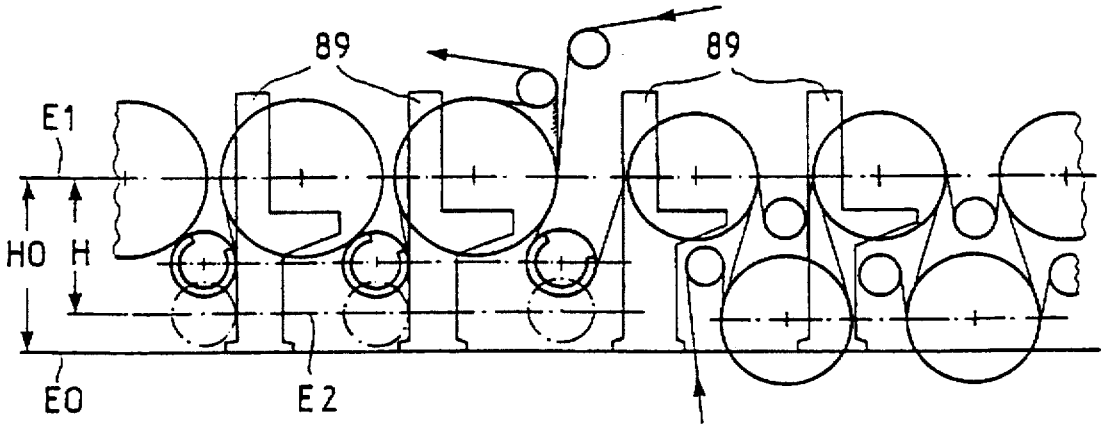

In accordance with FIG. 10 the following is provided, differing from FIGS. 1 and 2. The axes of the cylinders of the single-felt dryer group lie in the same horizontal plane E1 as the axes of the upper cylinders of the double-felt dryer group. Thus uniform stands `89 can be provided for all of these cylinders. Furthermore, in this way, the axes of the cylinders of the single-felt dryer group lie at a greater vertical distance HO above a reference plane EO than, for instance, the cylinders 56 in FIG. 1. It follows from this that the vertical distance H between the transfer suction rolls and the cylinders can be selected to be very large if evaporation paths still larger than in FIG. 9 are necessary between the cylinders. In this connection, the axes of the transfer suction rolls (indicated in dot-dash line) again lie at least approximately in the same horizontal plane E2 as the axes of the lower cylinders of the double-felt dryer group. The advantages described can be further increased if, in accordance with FIG. 11, the axes of the cylinders of the single-felt dryer group (plane El) are arranged above the axes of the upper cylinders of the double-felt dryer groups (plane E3).

Figure 12:
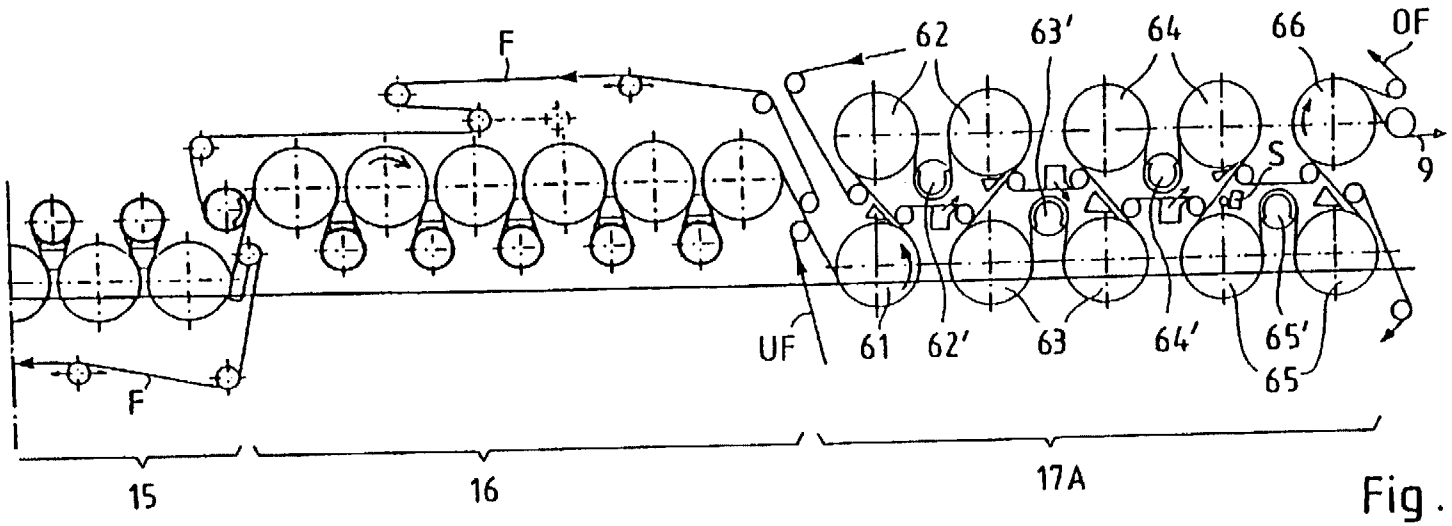
FIGS. 12 and 13 show other embodiments in a diagrammatic side view.

FIG. 12 shows an alternative to FIG. 1. The double-felt dryer group 17A is developed as follows in accordance with Federal Republic of Germany Patent 3 623 971. The paper web 9 travels first over a lower cylinder 61 and then, in succession, over two top cylinders 62 and then in succession over two bottom cylinders 63 and then, in succession, over the upper cylinders 64 and then in succession over two lower cylinders 65 and finally over an upper cylinder 66.

A guide suction roll 62'–65' is arranged between the cylinders of each cylinder pair 62–65. In this way, the number of open draws of the paper web between the two horizontal rows of cylinders is reduced by approximately one half. The threading of the tail can take place automatically in exactly the same manner as described above with reference to FIGS. 5 and 7, and therefore without ropes. Any paper broke obtained is automatically transported to the rear end of the dryer group 17A and pushed out there.

Figure 13:
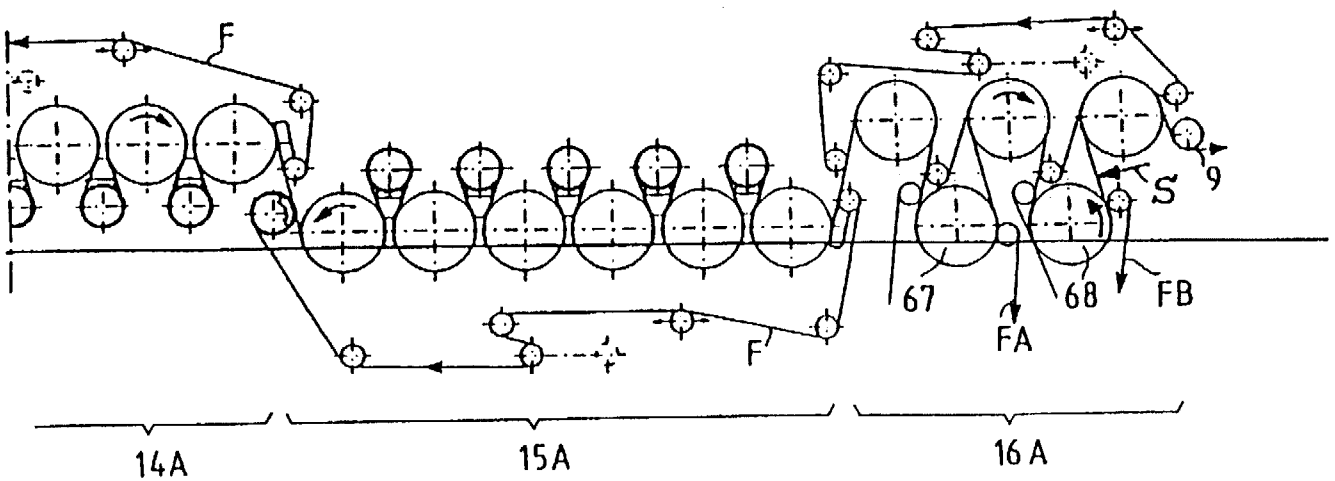

FIG. 13 shows that a bottom felted single-felt dryer group 15A can also be arranged directly in front or a double-felt dryer group 16A. In accordance with another alternative, each lower cylinder 67, 68 in the double-felt dryer group 16A has its own felt FA, FB in order to facilitate the discharge of broke. Note that the lower cylinders 67, 68 of the double-felt dryer group are horizontally aligned (same height) with the dryer cylinders of the preceding single-tier group.

Different from FIGS. 1–13, further equipment may be disposed between two of the dryer groups, e.g. between the last single-felt and the first double-felt dryer group.

Figure 18B:
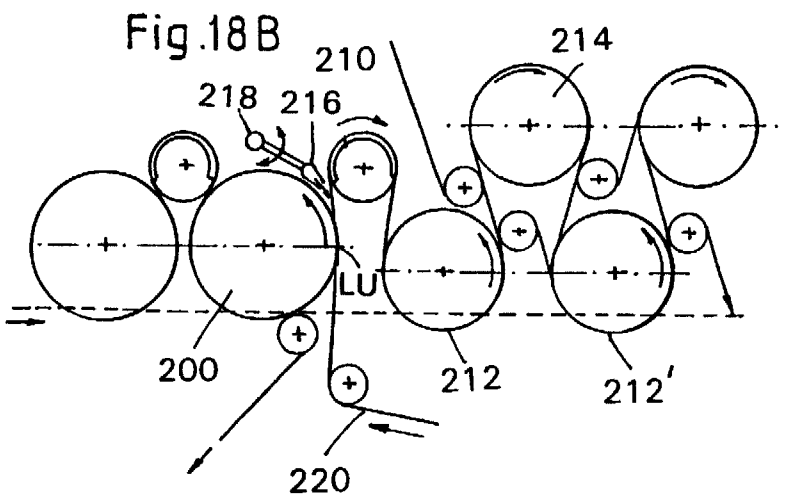
FIGS. 18A–18D illustrate web transfer arrangements between a bottom felted single-tier leading into a double-tier dryer group and further show different vertical alignments between the axes of the cylinders and guide rolls to a reference plane as well as the height alignment between the cylinders and guide rolls in the adjacent single-tier and double-tier dryer groups.
Figure 18A:
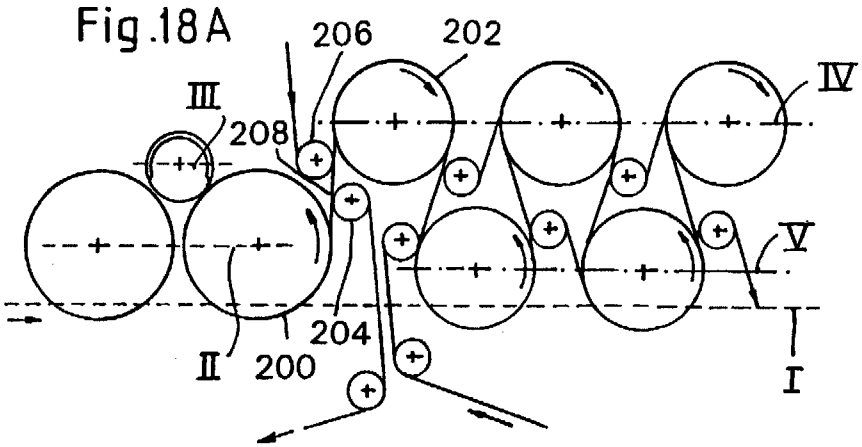

With reference to FIGS. 18A–18D, various Web transfer arrangements for transferring a paper web from a bottom felted single-tier to a double-tier dryer group are illustrated. In FIG. 18A, the cylinders of the single-tier dryer groups lie in a plane II, its vacuum rolls in a plane III, and both planes II and II are located between the planes IV and V respectively of the top and bottom dryer cylinders of the succeeding double-tier group.

The paper web 208 travels in a generally straight upward path from the last dryer cylinder 200 of the single-tier group to the leading top cylinder 202 of the double-tier group. The felt rolls 204 and 208 (of the single-tier and double-tier groups respectively), are situated close to one another to provide a relatively short open draw for the paper web at the transfer region. Note further that the diameter of the cylinders in the double-tier group is somewhat smaller than the cylinders in the double-tier group. This provides several advantages. It enables easier access to the pocket areas P1, P2, P3 between the top and bottom cylinders in the double-tier group. Further, if desired, it permits placement of the top and bottom cylinders closer to one another to reduce the size of the open draws of the paper web between the upper and lower cylinders in the double-tier dryer group. It also reduces the height above the floor of the upper cylinders 202, enhancing accessibility and servicing of the machine.

In accordance with FIG. 18B, the felt 220 of the bottom cylinders 212, 212' of the double-tier group makes a lick-up, tangent contact with the trailing cylinder 200 of the single-tier group at a point LU, where the paper web transfers to the felt 220, and thereafter guided around the vacuum roll 210 toward the leading bottom cylinder 212. During threading, an air nozzle or similar device 216 produces a jet of air to ensure that the leading end, i.e. tail, of the paper web continues with the felt 220. Air nozzle 216 can be supported on an arm which is connected at a pivoting mechanism 218 so that it can be removed from its illustrated location close to the cylinder, for example in order to facilitate the removal of broke from atop the cylinder 200.

Figure 18D:
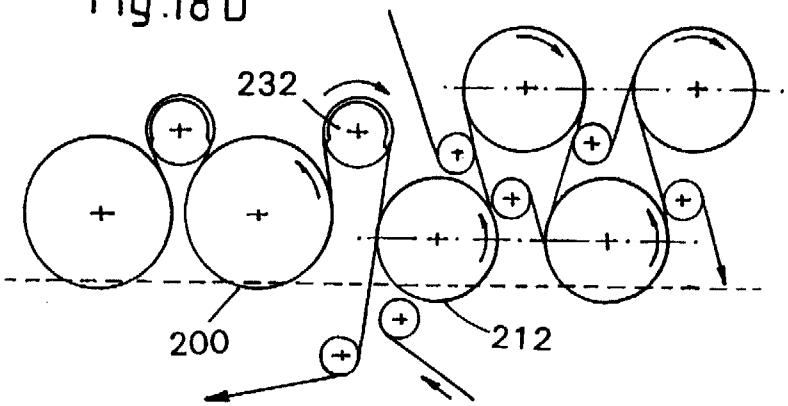
Figure 18C:
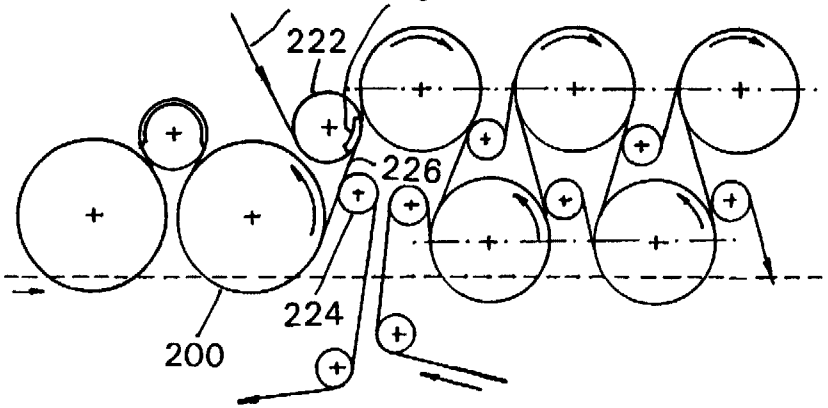

In accordance with FIG. 18C, the path of the paper web from the trailing cylinder 200 is toward the felt roll 224 and thereafter across a relatively short open draw 226 to a leading vacuum roll 222 toward the leading top cylinder of the double-tier group. The vacuum roll 222 is provided with a relatively short vacuum zone 228 to support the paper web against the felt 230 that is associated with a double-tier group.

FIG. 18D has an arrangement of drying cylinders and vacuum rolls as in FIG. 18B but differs therefrom in that the illustrated vacuum roll 232 is felted by the felt of the single-tier group and carriers the paper web to a lick-down, tangent contact with the leading bottom cylinder 212 of the double-tier group.

Figure 15:
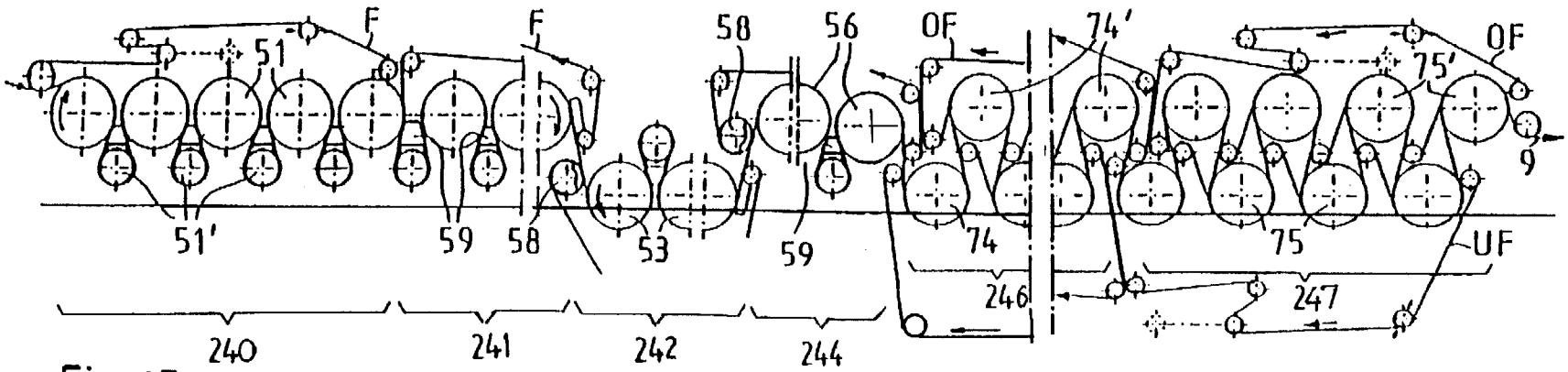
FIG. 15 illustrates yet another possible planar alignment between single-tier and double-tier groups.

FIG. 15 illustrates an arrangement wherein the paper web travels first through several single-tier dryer groups arranged alternatingly as a top felted single-tier group 240 followed by a bottom felted single-tier group 242, thence a top felted single-tier group 244 and terminating in a double-tier group 246. Note that in this arrangement the dryer cylinders of all of the top felted single-tier groups i.e. in the same plane as the cylinders of the upper tier of cylinders in the double-tier group 246. Similarly, the cylinders of the bottom felted dryer group 242 have their axis of rotation in the same horizontal plane as the axis of rotation of the bottom cylinders of the double-tier group.

Figure 16:
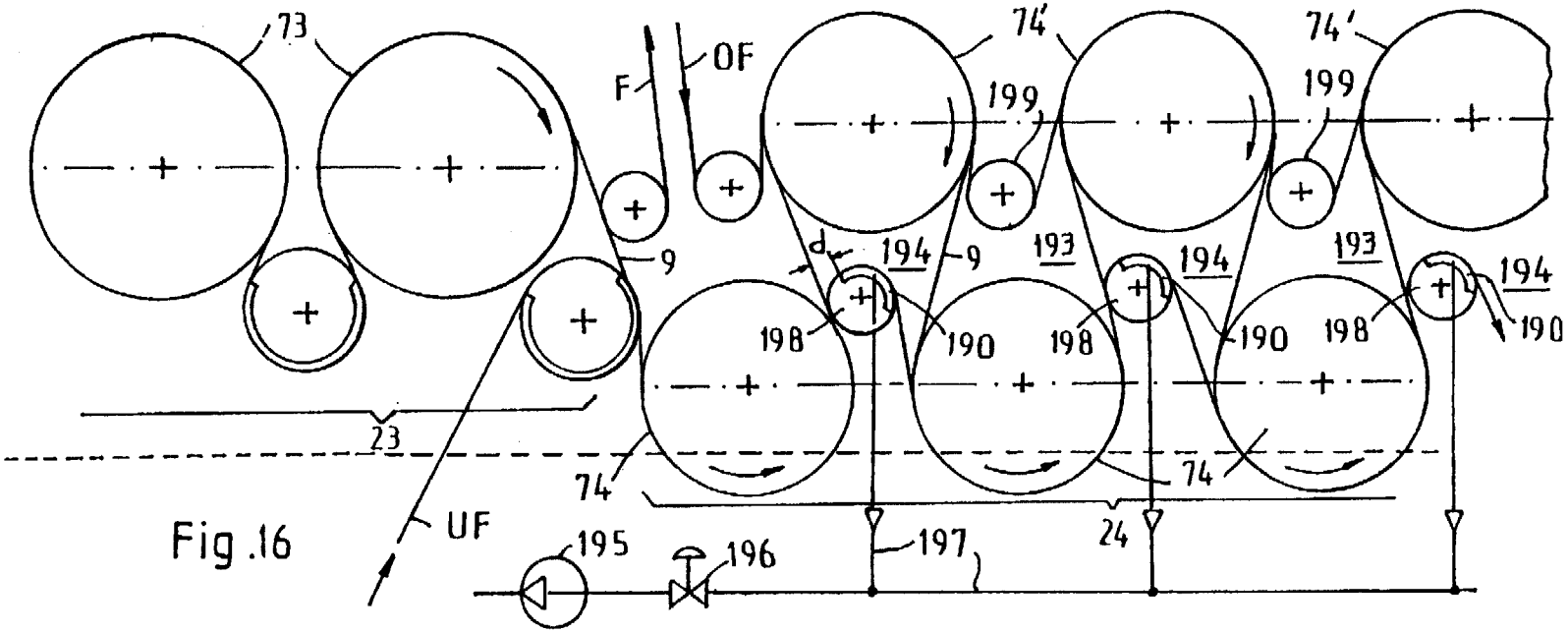
FIG. 16 shows a further embodiment of the invention, in a diagrammatic side view.

In FIG. 16, a further aspect of the invention is disclosed. The configuration shown in FIG. 16 is similar to that of FIG. 5 and comprises the last two dryer cylinders 73 of the last single-tier dryer group 23 having one felt and the first six cylinders 74, 75' of the first double-tier dryer group 24 having an upper felt OF and a lower felt UF as well as upper felt rolls 199 and lower felt rolls 198 with each felt roll being positioned between two adjacent dryer cylinders.

Either the upper felt rolls 199 or the lower felt rolls 198 are formed as suction rolls. (In a further alternative, all felt rolls 198 and 199 may be formed as suction rolls). In the embodiment shown, only the lower felt rolls 198 are suction rolls and are connected via suction lines 197 (comprising a control valve 196) to a suction blower 195. In operation, the lower suction felt rolls 198 remove moist air from every other pocket 194, namely from the pockets which are below the upper cylinders 74' and which "contact", i.e. which face, the bottom side of the paper web 9. Thus the evaporation of the bottom web side is being enhanced relative to the evaporation of the top web side. That mode of operation is able to eliminate any tendency of curl of the finished paper web which curl may result from the last single-tier dryer groups 23 or from other factors. More specifically, the enhanced evaporation of the bottom side of the web 9 counteracts a tendency of upward-curl, if any.

Accordingly, if there is a tendency of downward curl of the finished paper web, then additional moisture removal should be caused from the pockets 193 which are positioned above the lower cylinders 74. For that purpose the upper felt rolls 199 should be suction rolls (not shown in FIG. 16). If one cannot predict, whether there will be the tendency of upward-curl or of downward-curl, then all felt rolls 198 and 199 should be suction rolls in that case, the lower suction felt rolls 198 should be controllable by control valve 196 as shown in FIG. 20 and the upper suction felt rolls 199 should have a separate suction line (not shown) with a further control valve. It is then possible to enhance the evaporation of either the top side or the bottom side of the paper web 9 depending on the type of curl (downward or upward-curl) that occurs.

Instead of providing suction felt rolls, there are other possibilities to control the amount of evaporation of the two sides of the paper web. For example, if the drying cylinders are equipped with doctors (see FIG. 5), moist air may be removed through the hollow doctor beams. Another possibility is to blow dry air either into the pockets 194 which are positioned below the upper cylinders 74' or into the pockets 193 which are above the lower cylinders 74. For that purpose, air blowing devices (not shown) will be positioned below the lower felt rolls 198 and/or above the upper felt rolls 199 which devices blow dry air through the lower felt UF and/or the upper felt OF into the respective pockets 193/194. Such blowing devices per se are known to those skilled in the art.

The lower suction felt rolls 198 shown in FIG. 16 have a further advantage. If a web breakage occurs, paper broke is automatically transported—with the aid of the negative pressure in the lower suction felt rolls 198 from one lower cylinder 74 to the next lower cylinder 74 up to the end of the double-tier drying group 24. In that case of web breakage, the control valve of upper suction felt rolls, If those are present, should be immediately closed.

The suction felt rolls 198 have, as usual, a perforated roll shell and an internal suction which defines a suction zone 190, as schematically depicted. Note that the suction zone 190 is open to the adjacent pocket 194 and that there must be a distance "d" between the normal path of web 9 and the suction zone 190. Thereby it is avoided that the web might travel together with felt UF around the suction felt roll 198.

Figure 11:
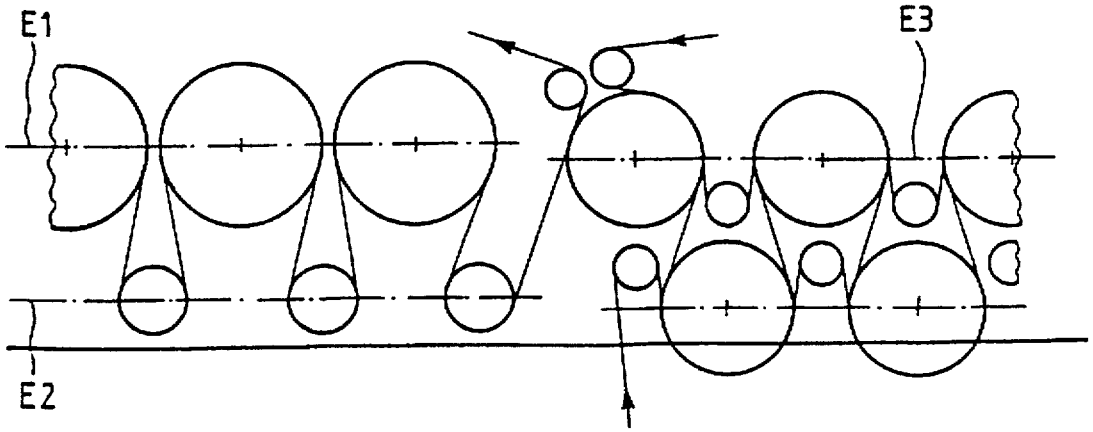

While FIG. 16 depicts one particular position for the lower suction rolls 198, the foregoing advantages are also attained when the felt suction rolls 198 are symmetrically disposed between the lower cylinders 74, as illustrated for example in FIG. 11.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for drying a paper web in a drying section, comprising the steps of:

a) providing a plurality of successively arranged dryer groups, each group including a plurality of heatable dryer cylinders which come into contact with the paper web;

b) conducting the paper web through a first, initial region of the dryer section, in which at least one of the dryer groups is configured as a single-felt dryer group in which a single endless felt and the paper web travel together meandering alternately over the dryer cylinders and over guide or transfer rolls;

c) thereafter conducting the paper web through a second region, at an end of the dryer section, directly or indirectly downstream of the single-felt dryer group which second region includes at least one double-felt dryer group in which the paper web travels meandering alternately over upper and lower drying cylinders, with an open draw of paper web being formed between the upper and lower cylinders;

d) threading a tail of the paper web through the at least one single-felt dryer group with an automatic ropeless tail guide device; and e) threading the tail with a further automatic ropeless tail guide device through the at least one double-felt dryer group; and f) directing first air jets at the paper web at the open draw to transfer the paper web across the open draw, the first air jets having air flow components flowing substantially in a direction opposite to that of the paper web.

2. The method of claim 1, in which the paper web is a tail being threaded through the drying section and the air jets are operated at least during threading of the tail.

3. The method of claim 1, further including providing second air jets which have flow components in the direction of the paper web path.

4. The method of claim 1, further including providing the first air jets on opposed sides of the paper web, so that the paper web is subjected to the first air jets from opposed sides thereof.

5. The method of claim 1, in which the flow direction of the first air jets is neatly precisely in a direction opposite to the direction of the paper web.

6. The method of claim 1, in which the first air jets have a first component of air flow directed opposite to the direction of the paper web path and a second component of air flow directed substantially perpendicularly to the direction of the paper web path.

7. The method of claim 1, in which the first, initial region of the dryer section includes a plurality of single-tier, top-felted dryer groups and an open draw of paper web between the single-tier, top-felted dryer groups and including the step of directing further air jets at the paper web at the open draw between the top-felted dryer groups to transfer the paper web across the open draw.

8. The method of claim 7, in which the further air jets have air flow components flowing substantially in a direction opposite to that of the paper web.

9. The method of claim 7, in which the top-felted dryer groups include a first top-felted dryer group and a second top-felted dryer group and in which the paper web is directed to travel directly off the surface of a last dryer associated with the first top-felted dryer group and unto a vacuum roll associated with a leading dryer of the second top-felted dryer group.

10. The method of claim 7, further including providing the further air jets on opposed sides of the paper web, so that the paper web is subjected to the further air jets from opposed sides thereof.

11. The method of claim 8, further including providing second further air jets at the open draw between the top-felted dryer groups, the second further air jets have flow components in the direction of the paper web path.

12. The method of claim 1, the method comprising the further steps of:

first guiding the paper web about a first drying cylinder of the double felt dryer group, with the paper web being held against the first drying cylinder by a first felt;

thereafter guiding the paper web about a second drying cylinder of the double felt dryer group, with the paper web being held against the second drying cylinder by a second felt;

providing an open draw path for the paper web between the first drying cylinder and the second drying cylinder in a transfer region between the first drying cylinder and the second drying cylinder; and directing a first air jet at the paper web at the open draw path to transfer the paper web from the first drying cylinder to the second drying cylinder, the first air jet having air flow components flowing in a direction opposite to that of the paper web.

13. The method of claim 12, in which the second drying cylinder is situated at an elevation higher than that of the first drying cylinder.

14. A method for threading a tail of a machine-wide travelling web, preferably paper web, into a dryer section for drying said web by means of a plurality of successively arranged dryer groups, each group including a plurality of heatable dryer cylinders which come into contact with the paper web, the method comprising:

conducting said tail automatically, by means of a ropeless tail guide means through a first, initial region of the dryer section, wherein at least one of the dryer groups is configured as a single-felt dryer group in which a single endless felt and the paper web travel together meandering alternately over the dryer cylinders and over transfer rolls, and through a second region at an end of the dryer section, directly or indirectly downstream of the single-felt dryer group wherein is provided at least one double-felt dryer group in which the paper web travels meandering alternately over upper and lower drying cylinders, with an open draw of paper web being formed between the upper and lower cylinders and including directing first air jets at the paper web at the open draw to transfer the paper web across the open draw, the first air jets having air flow components flowing substantially in a direction opposite to that of the paper web.

15. A dryer section for drying a paper web in a drying section, comprising:

a) a plurality of successively arranged dryer groups, each group including a plurality of heatable dryer cylinders which come into contact with the paper web;

b) in a first, initial region of the dryer section, at least one of the dryer groups is configured as a single-felt dryer group in which a single endless felt and the paper web travel together meandering alternately over the dryer cylinders and over guide or transfer rolls;

c) in a second region, at an end of the dryer section, directly or indirectly downstream of the single-felt dryer group, there is at least one double-felt dryer group in which the paper web travels meandering alternately over upper and lower drying cylinders, with an open draw of paper web being formed between the upper and lower cylinders;

d) the at least one single-felt dryer group has an automatic ropeless tail guide device for threading a tail through the single-tier dryer groups; and e) an automatic ropeless tail guide device associated with the at least one double-felt dryer group for threading the tail therethrough, said at least one double-felt dryer group being free of any rope-based tail guiding devices.

16. The drying section of claim 15, further including a scraper support body and wherein the first air jets are located on the scraper support body.

* * * * *